United States Patent [19]

Philip

[11] 4,322,014

[45] Mar. 30, 1982

[54] SPLASH-PROOF CONTAINER AND COVER

[76] Inventor: Morris Philip, Bronx, N.Y.

[21] Appl. No.: 138,444

[22] Filed: Apr. 22, 1980

Related U.S. Application Data

[63] Continuation-in-part of Ser. No. 61,197, Jul. 27, 1979, abandoned.

[51] Int. Cl.[3] ..... A47G 19/22; B65D 41/26

[52] U.S. Cl. ..... 220/85 SP; 206/499; 220/90.4; 220/90.6; 222/547; 222/570; 222/572; 229/7 R

[58] Field of Search ..... 220/90.2, 90.4, 90.6, 220/85 SP; 229/7 R; 222/482, 481, 564, 547, 570, 572; 206/499

[56] References Cited

U.S. PATENT DOCUMENTS

| | | | |
|---|---|---|---|
| 1,756,249 | 4/1930 | Kaufman . | |
| 2,414,697 | 1/1947 | Pettersson . | |
| 2,456,989 | 12/1948 | Polcyn . | |
| 2,529,114 | 11/1950 | Tellier | 220/90.4 |
| 2,646,200 | 7/1953 | Atkins | 229/7 R |
| 3,014,621 | 12/1961 | Povitz | 222/570 X |
| 3,085,710 | 4/1963 | McIlvoy | 215/329 X |
| 3,313,447 | 4/1967 | Spencer . | |
| 3,635,380 | 1/1972 | Fitzgerald | 220/90.4 X |
| 3,727,808 | 4/1973 | Fitzgerald | 220/90.4 X |
| 3,730,399 | 5/1973 | Dibrell et al. | 222/482 |

*Primary Examiner*—Allan N. Shoap

*Attorney, Agent, or Firm*—Morgan, Finnegan, Pine, Foley & Lee

[57] ABSTRACT

A splash-proof container and container cover in which the container has an opening for pouring liquid from the container, an air opening in the cover for bleeding air into and out of the container, a spout at the edge of the container and container cover adjacent the liquid opening for receiving and directing liquid poured through the liquid opening and baffle means on the bottom surface of the cover and extending under and across the liquid and air openings for preventing liquid from being splashed from the covered container.

14 Claims, 17 Drawing Figures

FIG. 3
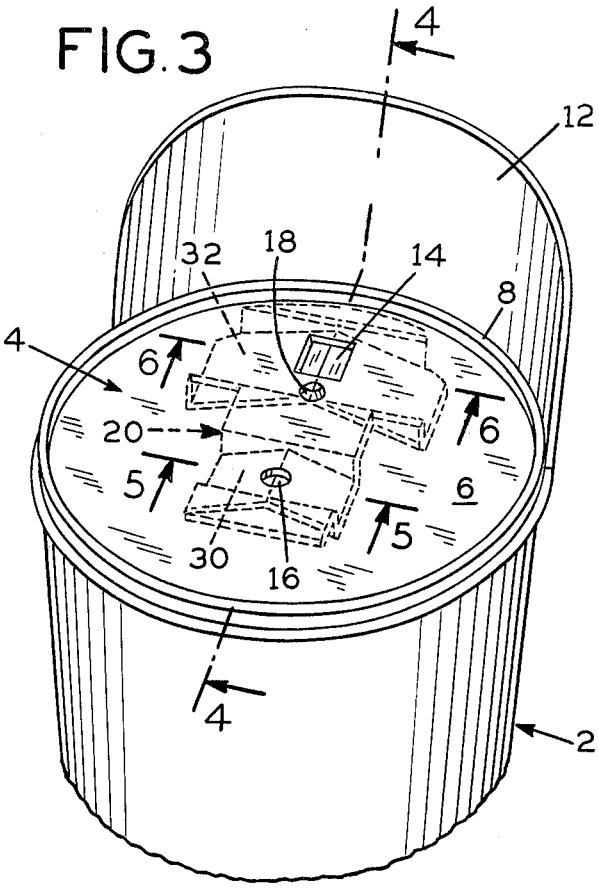
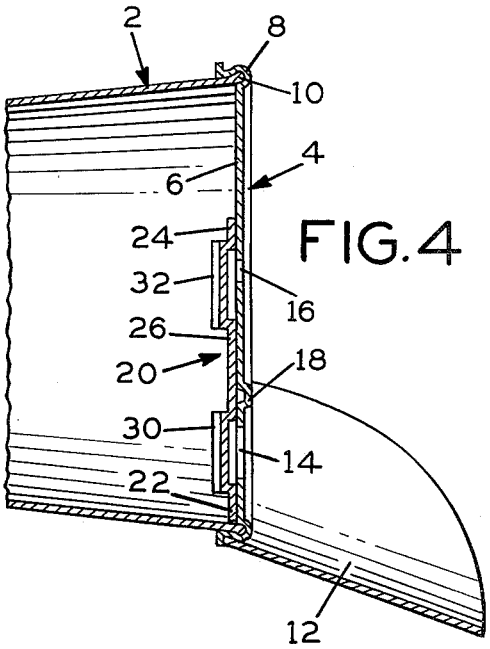
FIG. 4
FIG. 5
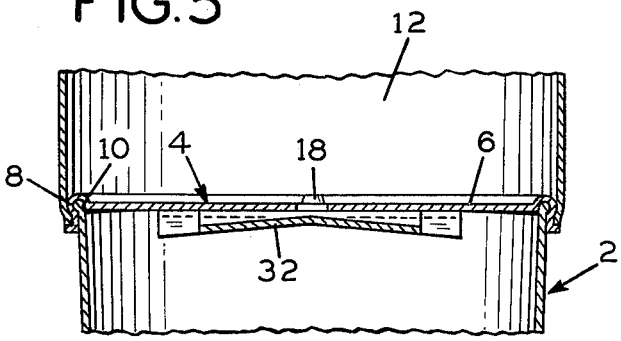
FIG. 6
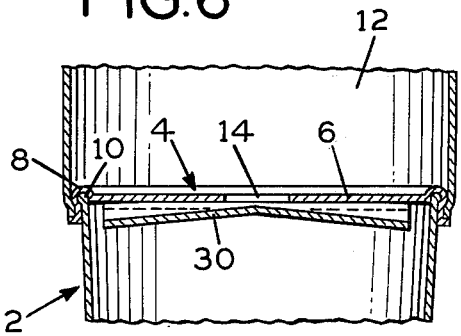
FIG. 7
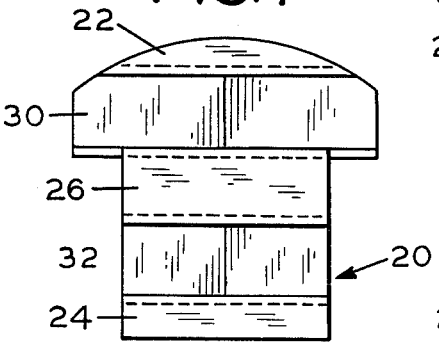
FIG. 8
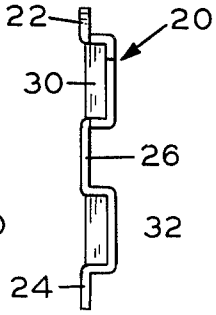
FIG. 9
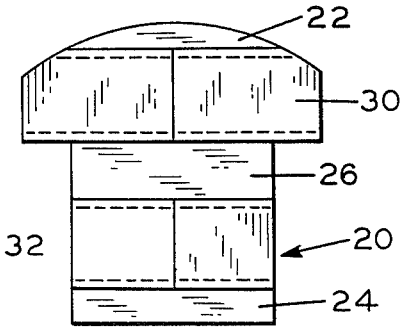

SPLASH-PROOF CONTAINER AND COVER

This application is a continuation-in-part of U.S. application Ser. No. 61,197, filed July 27, 1979, now abandoned, and relates to containers and container covers and, more particularly, to splash-proof containers and covers for use for drinking liquids such as hot or cold liquids.

When liquids, such as, coffee, tea, and the like, are served on airplanes, trains, busses and moving vehicles, irregular movement of such vehicles often cause the liquid to jiggle and splash. Such jiggling and splashing can cause the liquid to spill out of the cup and container and over the hands and clothing of the person using such cup or container and over the clothing of other persons in the vicinity of the user. If the liquid is hot, such spilling can cause injury. In any event, spilling of the liquid on clothing can cause damage, stains and inconvenience.

Various attempts have, heretofore, been made to provide a cup or container and cover for preventing splashing and spilling of liquid for use on airplanes, trains, busses and moving vehicles. Such attempts, however, have resulted in cups, containers and covers which are expensive to produce, are difficult and cumbersome to use or interfere with liquid flow in such a way as to be undesirable for the user. Most times, to minimize splashing and spillage, such as in airplanes, it is usual practice to serve the liquid, such as coffee, in a partially filled container, for example, to only half or two-thirds fill the container. This, of course, requires refilling or additional containers, further service and is expensive and inconvenient. For the person drinking the liquid, it is a source of annoyance.

The difficulties heretofore encountered in attempts to provide a splash-proof container and cover are overcome in the instant invention in a simple, efficient and economical manner and without inconvenience to the user in drinking from the container. This is accomplished by providing a container and cover having extending, transverse of the fluid and air openings in the cover and on the liquid side of such openings, a baffle or splash guard having a length longer than the length of the opening. The baffle or splash guard is spaced inwardly of the cover toward the liquid and, preferably, is sloped or curved downwardly from the center of the opening so that liquid which might flow thereon when the cup is shaken will flow downwardly and drain into the container. The container or cover of the instant invention, and, preferably, the container, is provided with a spout or lip which is used in drinking from the container. The spout or lip is placed to the lips of the user and, as the container or cup is tipped in the conventional drinking manner the liquid flows through the openings between the ends of the baffle and bottom cover surface, over the baffle and through the container cover opening onto the spout and to the lips of the user. At the same time air flows through the air opening in the cover to prevent vacuum in the container and provide smooth and even flow of the liquid. If, as in drinking from a conventional cup, the liquid is too hot to drink, the container may be tipped back toward its vertical position and the liquid will flow back into the container through the liquid opening in the cover. If the liquid is not too hot, the container may be held tipped and the contents may be consumed by the user. The container might also be tipped so that the hot liquid will flow in a thin stream across the spout so as to cool the liquid before it is consumed.

The invention of the instant application will be more fully understood from the following description taken with the appended drawings of preferred embodiments in which FIG. 1 is a side view, partly in section, of a cover incorporating the invention and shown mounted on a disposable container;

FIG. 3 is a perspective view of the cup and cover of FIG. 1 taken from the top of the cover;

FIG. 4 is a vertical section of the container cup of FIG. 3 taken at 4—4 FIG. 3;

FIG. 5 is a vertical section taken at 5—5 FIG. 3;

FIG. 6 is a vertical section similar to FIGS. 4 and 5 and taken at 6—6 FIG. 3;

FIG. 7 is a top plan view of the baffle member of FIGS. 3-6;

FIG. 8 is a side elevation view of the baffle member of FIG. 7;

FIG. 9 is a view of the baffle similar to FIG. 7 but taken from under the baffle;

Figure 1:
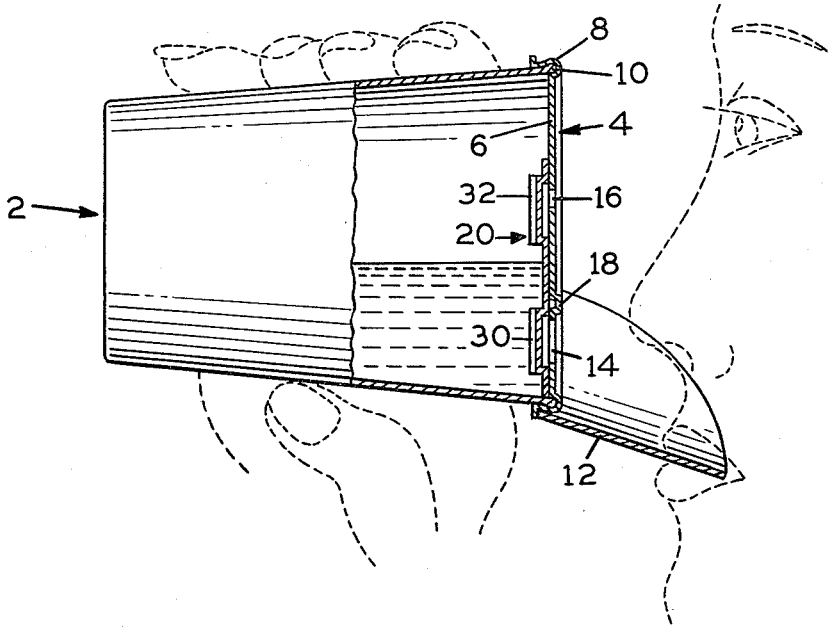

Referring to FIGS. 1, 3, 4, 5 and 6, the container, generally designated 2, can be of plastic, glass, ceramic or any other suitable material for holding and dispensing a liquid, for example, hot coffee, tea or the like, or a beverage. The cover, generally designated 4, may be of a disposable material, for example, inexpensive plastic, and may be stamped, pressed or molded into the required shape as will be described or may be of a more expensive, re-usable material, such as, glass, plastic, ceramic, metal or the like.

Cover 4 includes a closure lid 6 having, around its periphery, a groove 8 for engaging and gripping lip 10 on container 2. Spout 12 is affixed at its end to the outer margin of groove 8 and may be formed as a separate piece and attached, such as by glueing, cementing or heat sealing or cover 4 may be stamped, molded or formed so that spout 12 and cover 4 are a single, integral unit. Inward of groove 8 and substantially centered with respect to spout 12, closure 6 is provided with an opening 14 of a size to pass liquid and at or just beyond the center of closure 6 from liquid opening 14, an air opening 16 of smaller size. A stacking boss 18 extends upwardly from the outer surface of closure lid 6 of cover 4 to aid in the stacking of the covers as will be later explained.

A baffle member, generally designated 20, is mounted on the bottom surface of closure lid 6 of cover 4 and may be cast or molded as a composite unit with cover 4 or may be molded or stamped as a separate unit and glued, welded, heat sealed, or snapped into place to the bottom surface of closure lid 6. To assist in glueing, welding or heat sealing or to provide locations for snap connectors for mounting baffle member 20 on the bottom surface of closure lid 6, member 20 is provided with end flanges 22, 24 and a center flange 26 which, when mounted, are in contact with the bottom surface of closure lid 6. The end of flange 22 is rounded so as to receive and grip lip 10 on container 2.

Baffle member 20 is provided with a liquid opening baffle 30 mounted under liquid opening 4 and extending therebeyond and an air opening baffle 32 of smaller size and mounted under air opening 16 and extending therebeyond. As best shown in FIGS. 3, 5 and 6, baffle 30 slopes downwardly and away from the center of liquid opening 14 and baffle 32 slopes downwardly and away from the center of air opening 16.

Figure 10:
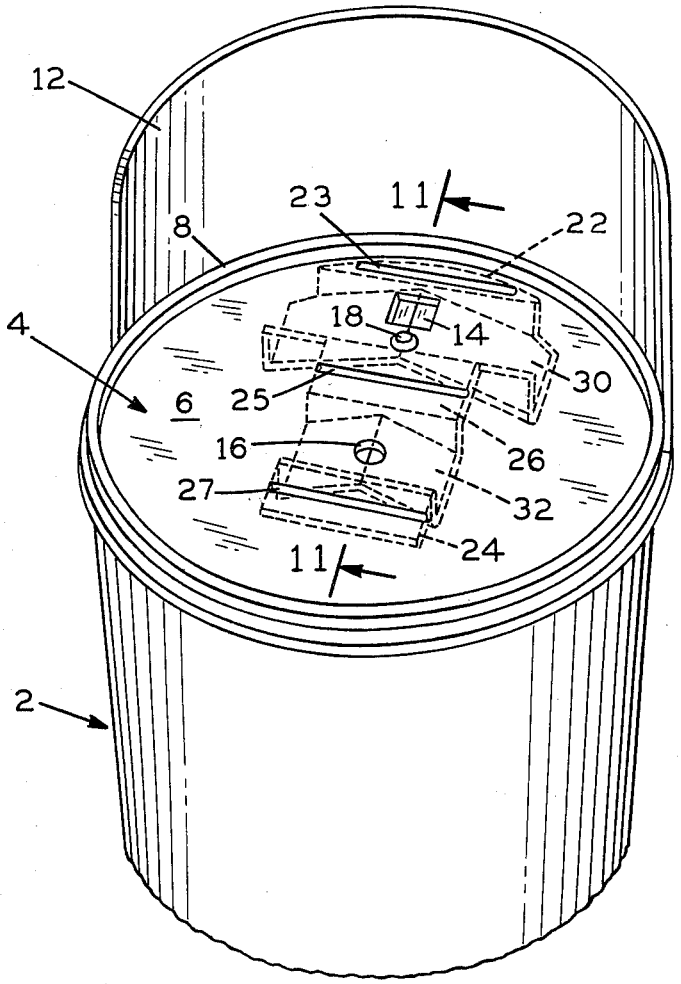
FIG. 10 is a view similar to FIG. 3 but showing a modified attachment.
Figure 11:
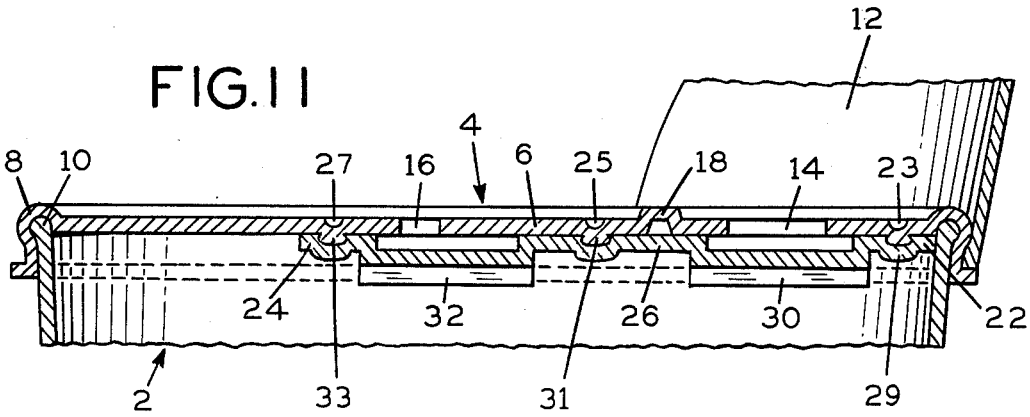
FIG. 11 is a vertical section taken at 11—11 FIG. 10.

As already noted, baffle member 20 may be cast or molded integral with cover 4 or, as best shown in FIGS. 3–9, may be glued, welded or heat sealed to the bottom surface of closure lid 6. For purposes of snap connecting baffle member 20 to the bottom surface of closure lid 6, the closure lid, as best shown in FIGS. 10 and 11 is provided with downwardly projecting ridges 23, 25 and 27 which form the male members of the snap connections and flanges 22, 24, 26 are provided with inwardly projecting ridges 29, 31, 33. As shown in FIG. 11, when baffle member 20 is snapped in place, inwardly projecting ridges or female snap members 29, 31, 33 are snapped onto outwardly projecting ridges or male snap members 23, 25 and 27.

With cover 4 in place on container 2 and with liquid in the container, groove 8 on cover 4 engages and grips lip 10 and holds the cover in place. With the covered contained in its normal, upright position and the container is shaken, such as by the movement in an airplane, train, bus or similar vehicle or the container is suddenly moved, the liquid is prevented from splashing out of the container by baffle member 20 and baffles 30, 32. The liquid rising up in the cup hits the bottom of baffles 30, 32 and is deflected back into the cup. Any liquid which might come up onto the top surface of baffles 30, 32 drains back into the cup along the sloping upper surfaces of the baffles. When it is desired to drink from the container, the container, with cover 4 remaining thereon, is tipped so that the end of spout 12, at its approximate center, is brought into contact with the lips and the container is then tipped in the normal fashion as though the container did not have a cover. As best shown in FIG. 1, with the container tipped, the liquid flows against the inner surface of cover 4, along the cover between baffle 30 and the inner cover surface and out through liquid opening 14 onto spout 12 and into the lips and mouth of the user. At the same time, air is admitted into the container through air opening 16 assuring a smooth flow of the liquid. Jarring of the container while the container is tipped and the liquid is pouring out does not cause spilling as often happens when an uncovered container in a vehicle, such as an airplane or train, is jarred during drinking. Once the container is returned to its upright position by the user, the cover again prevents the liquid from being splashed from the container by jarring.

Figure 2:
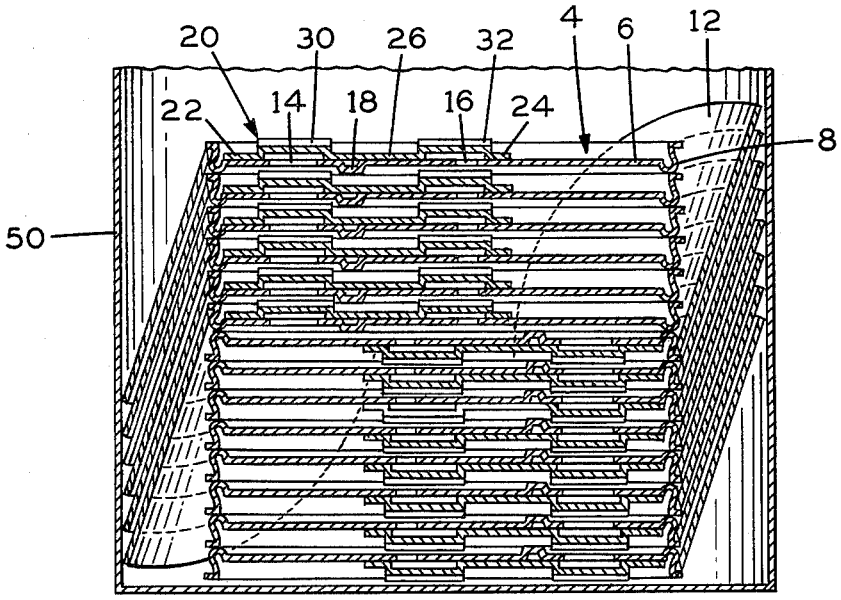
FIG. 2 is a side view, in section, showing the covers of FIG. 1 as stacked for storage and shipping.

The cover of the embodiment of the invention of FIGS. 1–11 is, conventionally, stored, shipped and may be even sold as a unit separate and apart from the container for which it is designed to fit. Thus, as best shown in FIG. 2, covers 4 nest, one above the other and are stacked so that the pouring spouts on a number of contiguous containers are nested, one in the other. After a sufficient number of covers have been so stacked with the pouring spouts nested, a like number of covers are stacked with the tops and the pouring spouts facing in the opposite direction. Thus, the height of such stack might be limited and the ends of the pouring spouts might be protected. As best shown in FIG. 2, the stacked and nested covers may be packed, shipped and stored in a protective cover 50 which may be, for example, a tube of plastic film such as polyethylene or similar material.

The embodiment of the invention in FIGS. 12–15 is essentially the same as in FIGS. 1–11 with the liquid spout formed as a part of the container, the cover rim modified to accommodate the container spout and the cover parts somewhat rearranged for production purposes.

Figure 12:
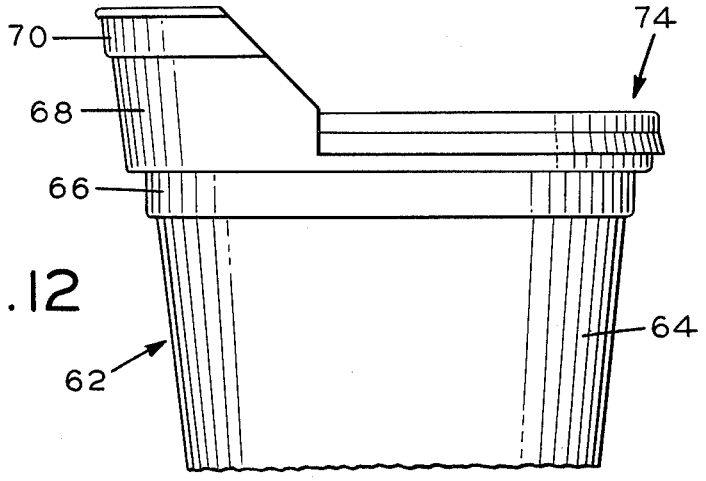
FIG. 12 is a side view of a modified form of the invention.
Figure 13:
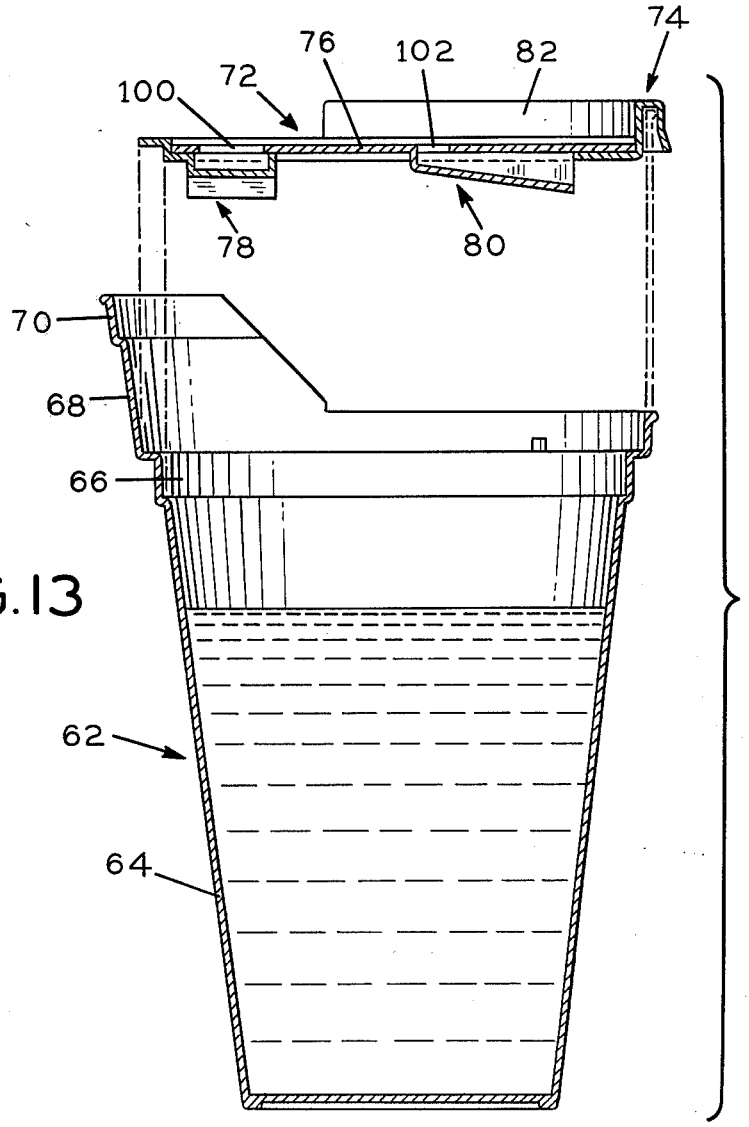
FIG. 13 is a vertical section of the container and cover of FIG. 12 showing the components in exploded form.

Referring to FIGS. 12 and 13, the container, generally designated 62, includes body portion 64, rim portion 66 and spout portion 68. The upper edge of spout 68 may have a rim 70, FIGS. 12 and 13, or may be plain, FIG. 14.

Figure 15:
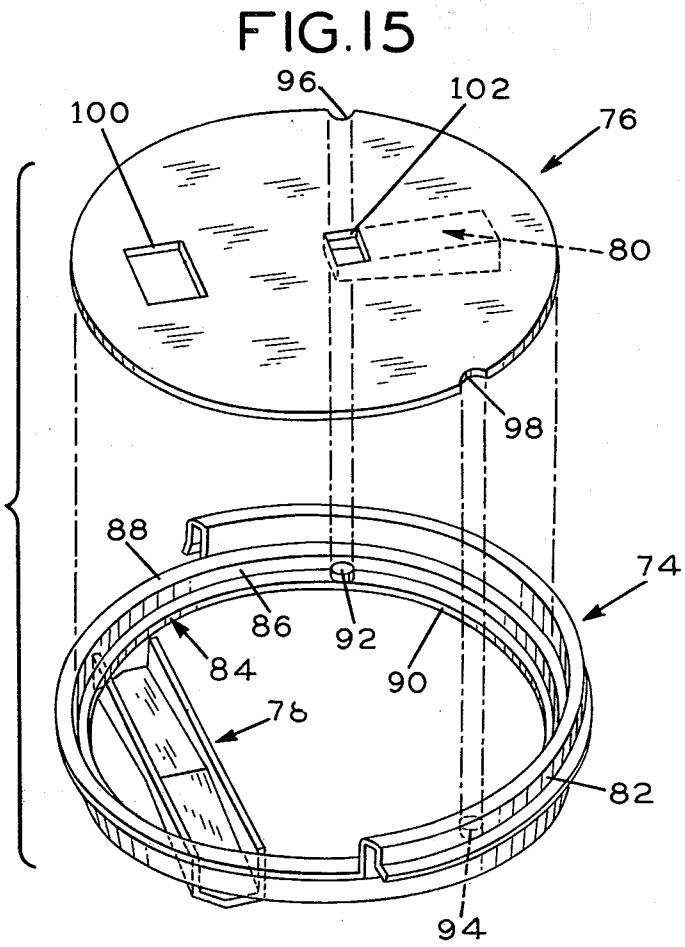
FIG. 15 is an exploded perspective view of the cover of FIG. 14.
Figure 14:
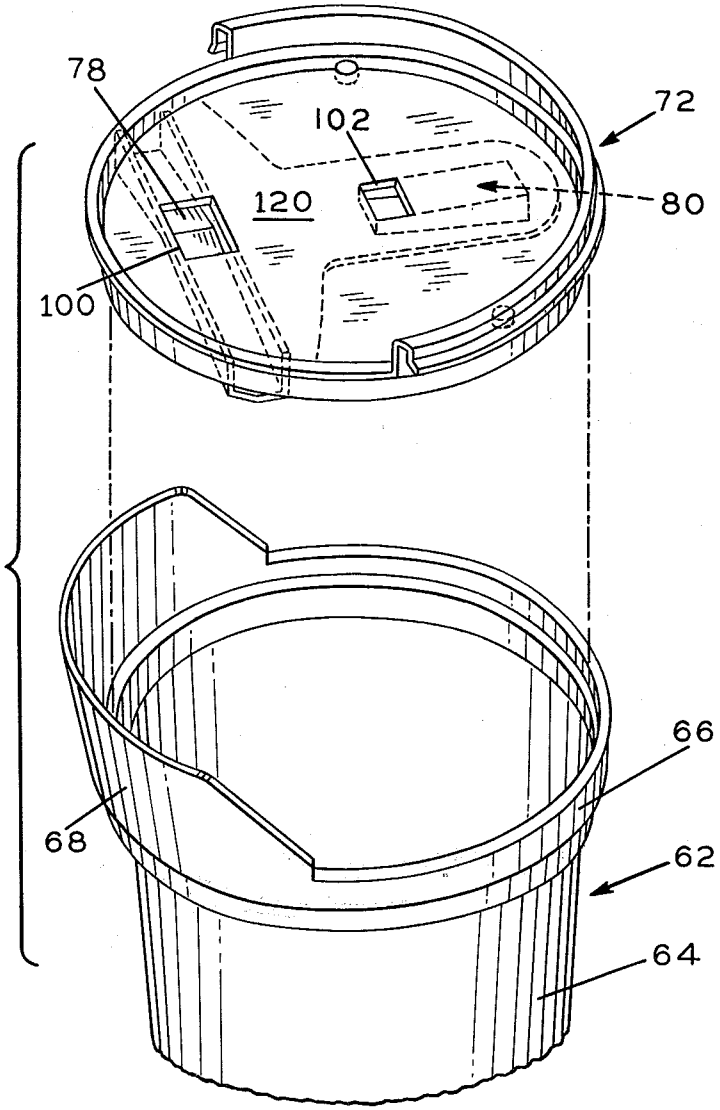
FIG. 14 is an exploded perspective view, taken from the top of the container and cover of FIGS. 12 and 13.

The cover, FIGS. 13–15, generally designated 72, is made up of a rim member, generally designated 74, a disc, generally designated 76, a liquid baffle, generally designated 78, and an air baffle, generally designated 80.

As best shown in FIGS. 12 and 15, rim member 74 has a groove portion 82 which extends partially around the periphery of container 62 and, when the cover is in place, grips and engages rim 66 from the ends of spout 68 to lock and hold cover 72 in place on the container. Rim 84 having a vertical wall 86, an upper outwardly extending horizontal wall 88 and a lower inwardly extending horizontal wall 90 extending circumferentially around rim member 74. Inwardly extending horizontal wall 90 has upwardly extending bosses 92, 94 for purposes later described.

Rim 76 has notches 96, 98 for engagement with bosses 92, 94, respectively, and openings 100, 102. Opening 100 is larger than opening 102 for reasons later more apparent.

Liquid baffle 78, having vertical side walls 104, 106 and downwardly, outwardly sloping bottom walls 108, 110 is glued, welded or heat sealed to the bottom surface of disc 76. Air baffle 80, having side walls 112, 114 and end wall 116 is glued, welded or heat sealed to the bottom surface of disc 78. Baffles 78, 80 might also be cast, stamped or molded as a single unit 120, FIG. 14, and the single unit might then be glued, welded, heat sealed or otherwise attached to the bottom of disc 76.

With cover 72 assembled and in place on container 62, cover groove portion 82 engages container rim 66 and locks and holds cover 72 on container 62. The cover is placed on the container, of course, after the container has been filled or partially filled with the liquid to be dispensed. In filling the container, the liquid level should be below the bottom most edge of baffles 78, 80 when the container is in upright position. To dispense the liquid, the top of spout 68 is brought into contact with the lips and the container is then tipped in the normal fashion. The liquid flows out, air is admitted to the container and the liquid is prevented from splashing in this embodiment in the same fashion as the embodiment in FIGS. 1–11.

Figure 16:
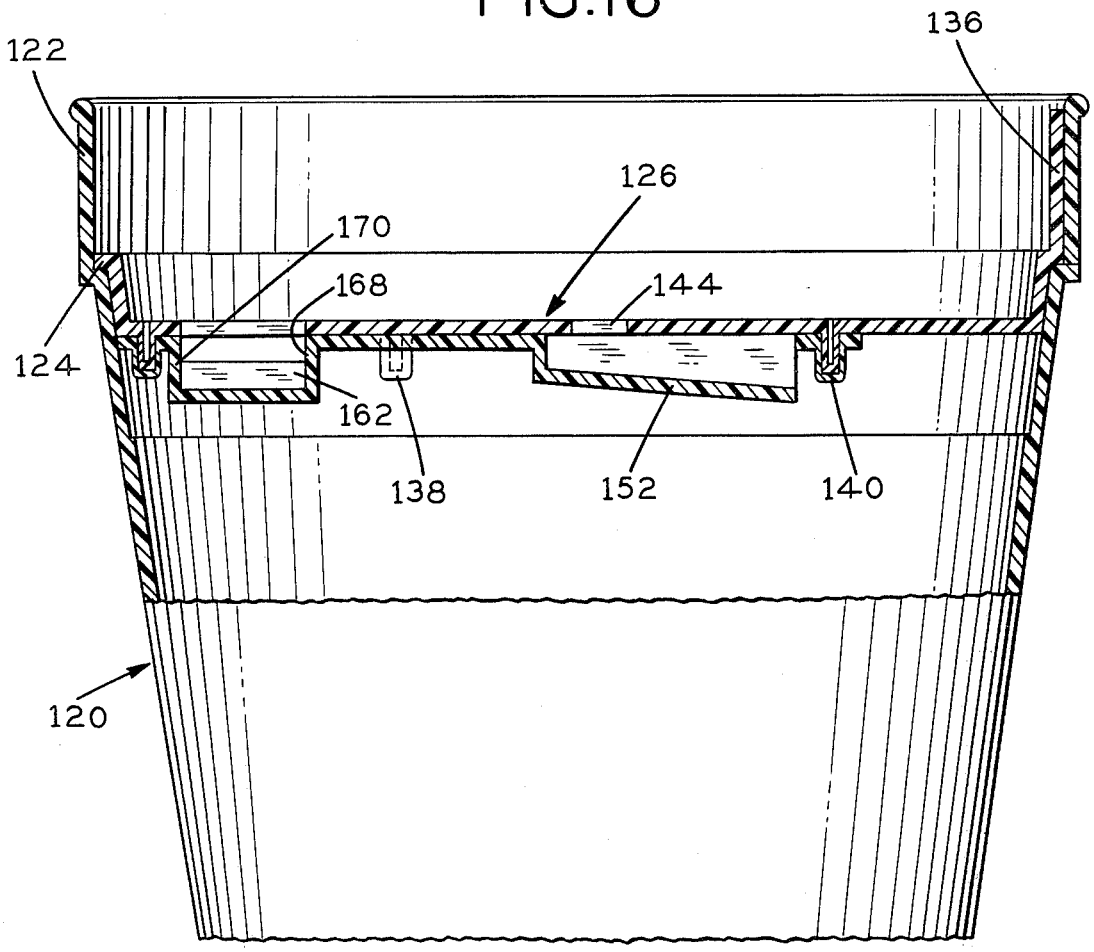
FIG. 16 is a vertical section of a further modification of the invention and showing the invention in its best contemplated mode.
Figure 17:
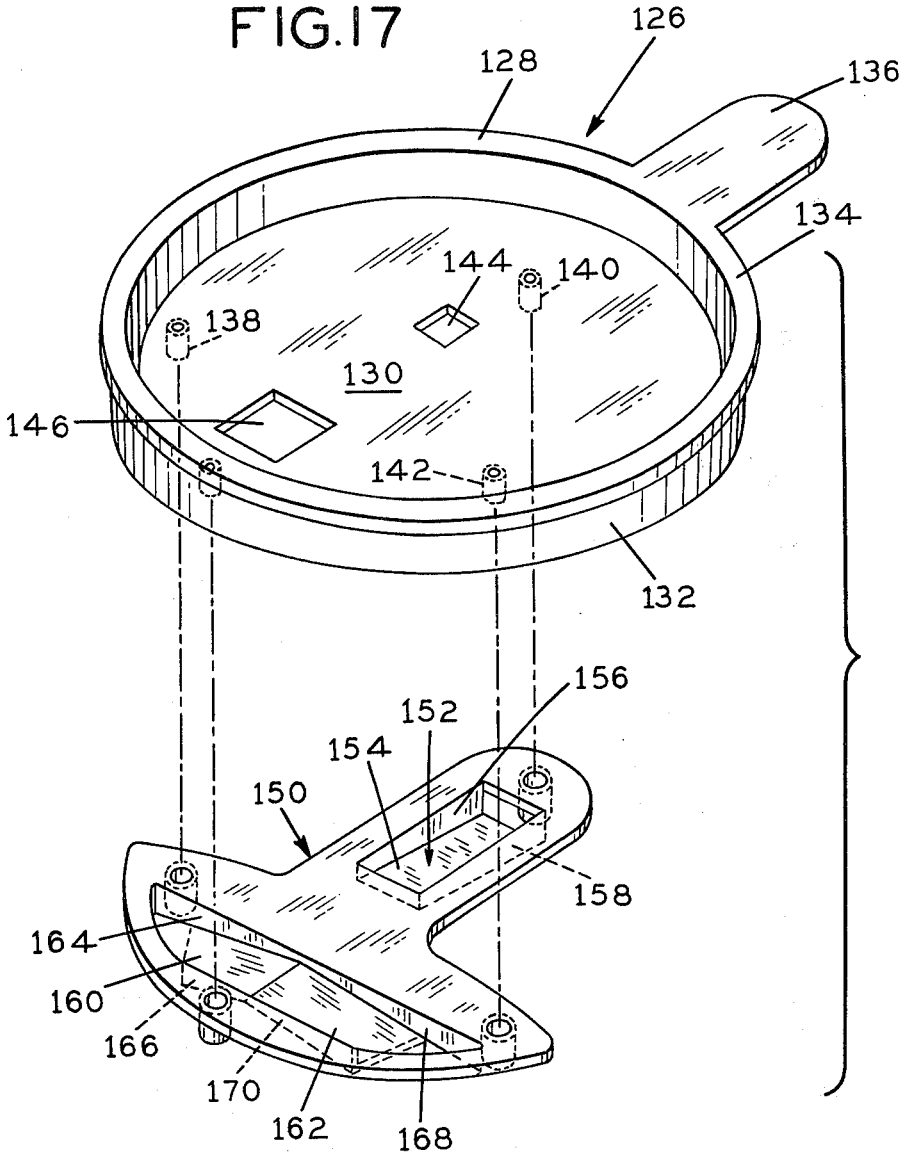
FIG. 17 is an exploded perspective view of the cover of FIG. 16.

The preferred embodiment of the invention and the best mode contemplated for the practice thereof is illustrated in FIGS. 16 and 17, In such embodiment, the container, generally designated 120, is provided with pouring spout 122 formed integral with and extending circumferentially around the container top or open end. A ridge or lip 124 extends circumferentially around the container at the base of pouring spout 122 for purposes later described.

Referring to FIGS. 16 and 17, the cover, generally designated 126, consists of disc 128 having a planar portion 130, a vertical extending wall 132 extending around and integral with the edge of disc 128 and an outwardly extending flange 134, having a tab 136, extending around and projecting outwardly from vertical wall 132. Lugs 138, 140, 142 are molded onto and project downwardly from the bottom of disc 128. At its approximate center, disc 128 is provided with air opening 144 and adjacent its periphery and opposite tab 136 with liquid opening 146.

Baffle member 150, having integrally molded therein an air baffle 152 with sloping bottom wall 154 and side walls 156, 158 and liquid baffles 160, 162 sloping downwardly and outwardly, with side walls 164, 166 and 168, 170, respectively, is snap fastened to the bottom of planar portion 130 of disc 128 by holes 172, 174, 176 which receive lugs 138, 140, 142, respectively. Any suitable snap fastening means may be substituted for the holes and lugs.

After container 120 has been filled, cover 126 is pressed into place in spout 122 so that flange 134 engages lip 124. As cover 126 is pressed into place, tab 136 is bent up along pouring spout 122 opposite liquid opening 146. Tab 136 forms a convenient means for removing cover 126 from container 120 should removal of the cover be desired.

With container 120 filled or partially filled with liquid and cover 126 in place, the edge of spout 122 at the side of the cover 126 adjacent liquid opening 146 is placed in contact with the lips and the container is then tipped in the normal fashion. The liquid flows out, air is admitted to the container and the liquid is prevented from splashing in the same manner as in the other embodiments.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed:

1. A splash-proof cover for a drinking cup comprising, a circular disc having a snap fitting periphery for engagement with a cup rim, an opening in said disc for dispensing liquid from said cup through said opening in said disc and a splash guard under said opening and secured to the inside of said disc, said splash guard extending across and beyond the periphery of said opening and being spaced at a fixed distance from said opening on the inner surface of said disc and sloping laterally downwardly from said opening in said disc and forming with the inner surface of said disc at least one passageway spaced laterally from the periphery of said disc opening for the flow of liquid from said cup when said cup is tipped toward said disc opening but for preventing liquid from flowing from said cup through said disc opening when said cup and said liquid therein is jarred with said cup in a vertical position.

2. A splash-proof cover, as recited in claim 1, in which said disc has a second opening spaced horizontally on said disc adjacent the center of said disc for bleeding air into and out of said cup and said splash guard extends across said second opening.

3. A splash-proof cover, as recited in claim 2, in which said splash guard includes a deflector extending across and spaced from said second opening in said disc.

4. A splash-proof cover, as recited in claim 3, in which said splash guard deflector slopes laterally downwardly from the center of said disc openings and in opposite direction from the center toward opposite ends of said openings for draining liquid from the upper surface of said splash guard deflector into said cup.

5. A splash-proof cover, as recited in claims 1, 2, 3, or 4, in which said cover has a drink spout fixed to said cover adjacent said dispensing opening.

6. A splash-proof cover, as recited in claims 1, 2, 3 or 4, in which said cover has a drink spout fixed to said cover adjacent said dispensing opening and said drink spout slopes vertically outwardly from the marginal edge of said lid adjacent said dispensing opening.

7. A splash-proof cover, as recited in claim 1, in which said splash guard opening spaced from said disc opening is substantially at right angle to said disc opening.

8. A splash-proof drinking cup and cover comprising a cup having a rim, a circular disc having a snap fitting periphery for engagement with said cup rim, an opening in said disc for dispensing liquid from said cup through said opening in said disc and a splash guard under said opening and secured to the inside of said disc, said splash guard extending across and beyond said opening and being spaced at a fixed distance from said opening on the inner surface of said disc and sloping laterally downwardly from said opening in said disc and forming with the inner surface of said disc at least one passageway spaced from the periphery of said disc opening for the flow of liquid from said cup when said cup is tipped toward said disc opening but for preventing liquid from flowing from said cup through said disc opening when said cup and said liquid therein is jarred with said cup in a vertical position, the laterally downwardly sloping splash guard forming a drain for the flow of liquid backwardly into the cup when said cup is in a vertical position.

9. A splash-proof drink cup and cover, as recited in claim 8, in which said disc has a second opening spaced horizontally on said disc adjacent the center of said disc for bleeding air into and out of said cup and said splash guard extends across said second opening.

10. A splash-proof drinking cup and cover, as recited in claim 9, in which said splash guard includes a deflector extending across and spaced from said second opening in said disc.

11. A splash-proof drinking cup and cover, as recited in claim 10, in which said splash guard deflector slopes laterally downwardly from the center of said disc openings and in opposite direction from the center toward opposite ends of said openings for draining liquid from the upper surface of said splash guard deflector into said cup.

12. A splash-proof drinking cup and cover, as recited in claims 8, 9, 10 or 11, in which said cover has a drink spout fixed to said cover adjacent said dispensing opening.

13. A splash-proof drinking cup and cover, as recited in claims 8, 9, 10 or 11, in which said cup has a drinking spout projecting upwardly of said cup from said rim.

14. A splash-proof drinking cup and cover, as recited in claims 8, 9, 10 or 11, in which said cup has a drinking spout projecting upwardly of said cup from said rim and extending circumferentially around said cup.

* * * * *